United States Patent [19]

Kimata et al.

[11] 4,373,490

[45] Feb. 15, 1983

[54] FUEL INJECTION APPARATUS

[75] Inventors: Kei Kimata, Ama; Tsugito Nakazeki, Iwata, both of Japan

[73] Assignee: NTN Toyo Bearing Company, Limited, Osaka, Japan

[21] Appl. No.: 225,111

[22] PCT Filed: Jun. 20, 1980

[86] PCT No.: PCT/JP80/00140

§ 371 Date: Jan. 14, 1981

§ 102(e) Date: Jan. 14, 1981

[87] PCT Pub. No.: WO81/00020

PCT Pub. Date: Jan. 8, 1981

[30] Foreign Application Priority Data

Jun. 25, 1979 [JP] Japan ..... 54-80605

[51] Int. Cl.[3] ..... F02D 3/00

[52] U.S. Cl. ..... 123/452; 123/446

[58] Field of Search ..... 123/452, 440, 445, 446, 123/462, 463

[56] References Cited

U.S. PATENT DOCUMENTS 2,493,582 1/1950 Hunt ..... 123/452
2,493,587 1/1950 Lee ..... 123/452
3,993,034 11/1976 Passera et al. ..... 123/452

FOREIGN PATENT DOCUMENTS 53-9919 1/1978 Japan ..... 123/452
54-44131 4/1979 Japan ..... 123/452
55-48003 3/1980 Japan ..... 123/452
55-114861 9/1980 Japan ..... 123/452

*Primary Examiner*—P. S. Lall
*Attorney, Agent, or Firm*—Armstrong, Nikaido, Marmelstein & Kubovcik

[57] ABSTRACT

A fuel injection apparatus of the type in which the degree of opening of a fuel measuring gate disposed in a fuel supply passage is controlled by air flow rate detecting means for detecting the rate of flow of air being sucked into an engine, and the amount of fuel is controlled by a solenoid valve adapted to be opened and closed by signals which detect the operating conditions of the engine, thereby compensating the air-fuel ratio, wherein a second solenoid valve is disposed in parallel with the first-mentioned solenoid valve and adapted to be opened and closed by the above-mentioned signals, so as to correct the basic air-fuel ratio which is set in connection with the air flow rate detecting means and the fuel measuring gate, thereby maintaining the air-fuel ratio at a desired constant value.

9 Claims, 6 Drawing Figures

FUEL INJECTION APPARATUS

TECHNICAL FIELD

The present invention relates to a fuel injection apparatus of the type which maintains at a predetermined value the pressure difference across a throttle valve (air flow rate detecting valve) disposed in a suction pipe to thereby detect the flow rate of air being sucked into an engine from the degree of opening of said throttle valve, while uniquely establishing correspondence between the degree of opening of said throttle valve and the area of opening of a fuel measuring gate, and maintaining the pressure difference across said fuel measuring gate at a predetermined value, and which adjusts said predetermined value by the on-off action of a solenoid valve, thereby compensating the air-fuel ratio.

BACKGROUND TECHNIQUE

Recently, a variety of apparatuses of this type have been developed and the present application also has already proposed one such apparatus. These apparatuses are designed so that signals from sensors which detect the operating conditions of an engine cause the on-off operation of a solenoid valve disposed in a fuel pressure control circuit, thereby changing the pressure difference across a fuel measuring gate to compensate the air-fuel ratio according to the operating conditions of the engine. If the output time ratio between rich and lean signals from said sensors (which corresponds to the on-off time ratio of the solenoid valve) deviates from a predetermined value, the pressure in the bellows of a servomechanism which detects the air flow rate is changed by a heater so as to correct the basic air-fuel ratio, which is set by said servomechanism, to maintain said time ratio at a predetermined value, thereby maintaining said air-fuel ratio at a desired constant value while reducing the time required to effect said compensation of the air-fuel ratio to suit it to the operating conditions of the engine and improving the response characteristic of the engine.

However, there are cases where the bellows of the servomechanism has to be reduced in size depending upon the design conditions thereof, and the operation of installing said heater in such bellows is not easy. Further, it requires a high degree of skill to insulate the heater and bellows from each other and at the same time seal the bellows to prevent leakage of the gas contained therein. Thus, it has been desired to improve said arrangement.

Accordingly, in view of the above described drawbacks of the apparatus previously proposed by the present applicant, it is an object of the present invention to provide an improved apparatus.

DISCLOSURE OF THE INVENTION

According to the present invention, the heater disposed in the bellows of the servomechanism of the conventional apparatus described above is replaced by a second solenoid valve placed in the fuel pressure control circuit in parallel with said first solenoid valve so that the on-off operation of said second solenoid valve corrects the basic air-fuel ratio. With such arrangement, it is possible to eliminate the drawbacks inherent in the conventional apparatus without losing the merits thereof.

OPTIMUM FOR EMBODYING THE INVENTION

The arrangement of the present invention will now be described in more detail with reference to the drawings showing an embodiment thereof.

Figure 1:
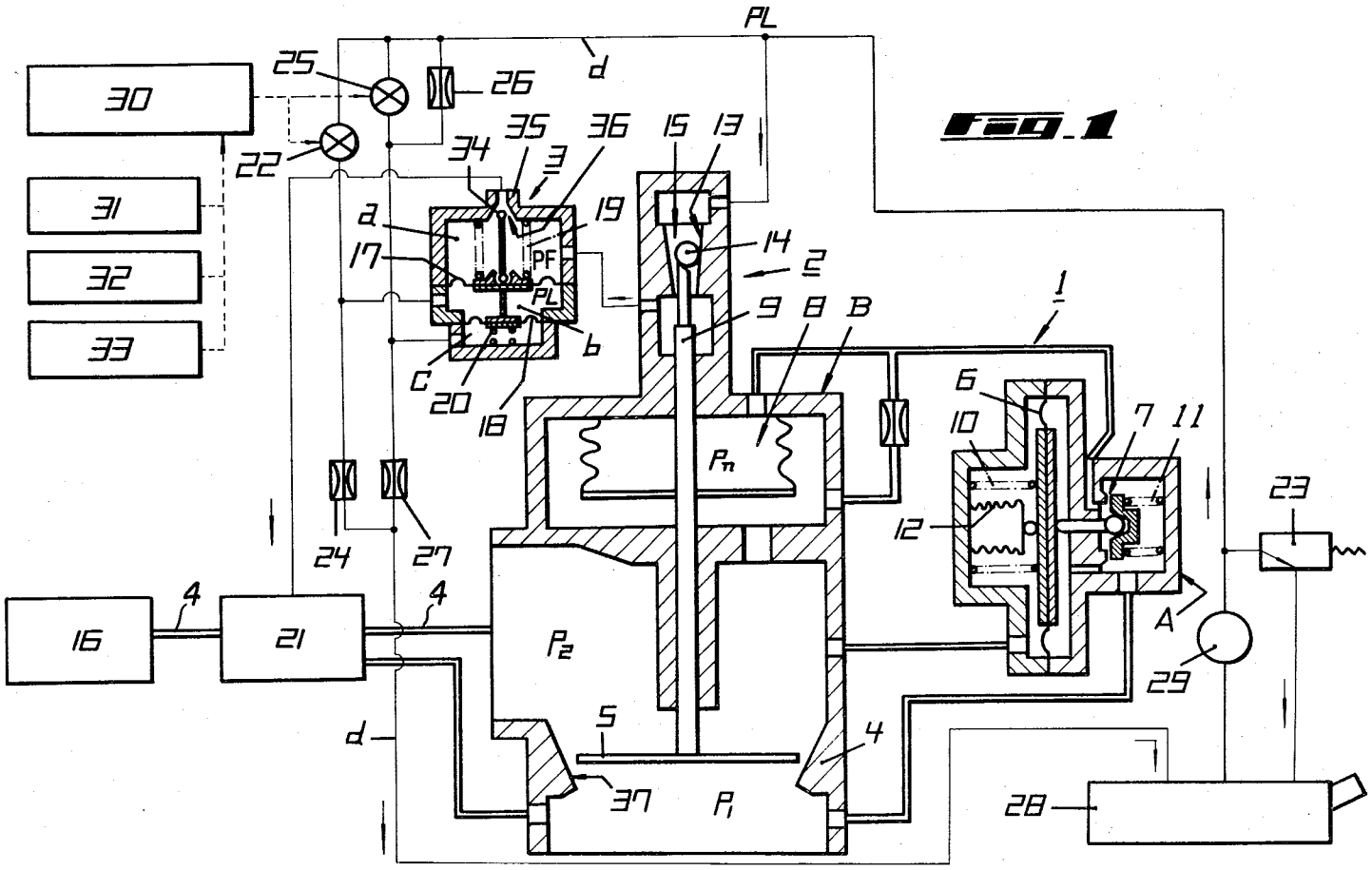
FIG. 1 is a view showing the present inventive apparatus in its entirety.

In FIG. 1, the numeral 1 denotes an air flow rate measuring unit comprising a servomechanism A and a valve opening mechanism B; 2 denotes a fuel flow rate measuring unit; and 3 denotes a pressure difference adjuster. The servomechanism A senses the pressure difference $P_1-P_2$ across a throttle valve 5 (air flow rate detecting valve) disposed in a suction pipe 4 by means of a diaphragm 6 and operates in such a manner that if $P_1-P_2$ deviates from a basic set value, it changes the area of opening of a variable orifice 7 and changes a driving pressure $P_n$ in the valve opening mechanism B, which changes between $P_1$ and $P_2$ in proportion to said area of opening, in corresponding relation to said deviation and delivers it to an actuator 8 so as to correct the degree of opening of the flow rate detecting valve 5 in a direction which makes the pressure difference $P_1-P_2$ constant, so that the area of opening of said flow rate detecting valve 5, namely, the area of a clearance defined between the peripheral edge of the detecting valve 5 and the inner surface 37 of a conical hole is proportional to the flow rate of the air passing through said clearance and therefore the flow rate of the air can be measured from the area of opening of the air flow rate detecting valve 5. The air flow rate measuring unit 1 is a so-called area type air flow rate measuring unit.

Changes in the area of opening of the air flow rate measuring unit 5 are proportional to axis displacements of a rod 9. The fuel flow rate measuring unit 2 operates in association with the rod 9, whereby the air flow rate and the fuel flow rate which is measured by the measuring unit 2 are maintained in proportional relation, thereby providing a constant air-fuel ratio. As for the pressure difference across the air flow rate detecting valve 5, it is determined by the basic set value of the servomechanism A, namely, the force relation between the spring forces of springs 10, 11 and a bellows 12 and the pressing force with which a gas at standard pressure and temperature (for example, 1 atm. and 20° C.) contained in the bellows 12 acts on the diaphragm 6, whereby the area of opening of the air flow rate detecting valve 5 and the axial displacement of the rod 9 are determined, so that said air-fuel ratio can be found by the basic set value of the servomechanism A. This air-fuel ratio is reputed basic air-fuel ratio. In addition, it is to be understood that the fuel flow rate measuring unit 2 operates in proportion to the degree of opening of the flow rate detecting valve 5.

The fuel flow rate measuring unit 2 has a ball 14 received in a tapered hole 13 and the clearance defined between the surface of said ball 14 and the inner surface of the hole 13 constitutes a crescent fuel measuring gate 15 the area of whose opening changes linearly. In this case, the position of the ball 14 within the hole 13 is controlled by the rod 9 which moves axially in proportion to the degree of opening of the air flow rate detecting valve 5. Therefore, the area of opening of the measuring gate 15 is proportional to the degree of opening of the flow rate detecting valve 5, i.e., the flow rate of air being sucked into the engine 16. The pressure difference $P_L-P_F$ across the measuring gate 15 is maintained at a predetermined value by the pressure difference adjuster 3, whereby the flow rate of fuel flowing through the measuring gate 15 is proportional to the area of opening thereof, so that a predetermined air-fuel ratio can be obtained.

The pressure difference adjuster 3 has chambers a, b and c which are separated from each other by diaphragms 17 and 18, and springs 19 and 20 are disposed in the chambers a and c, respectively. The chamber a has introduced thereinto the pressure $P_F$ existing in the downstream side of the fuel measuring gate 15 and communicates with an atomizer 21 disposed in the path from the suction pipe. A line pressure $P_L$ (which is a pressure existing in the upstream side of the measuring gate 15) maintained at a predetermined value by a relief valve 23 is introduced into the chamber b through a first solenoid valve 22 disposed in a fuel pressure control circuit d. The numeral 24 denotes an orifice disposed in the fuel pressure control circuit d on the downstream side of the chamber b. The line pressure $P_L$ is introduced into the chamber c through a second solenoid valve 25 disposed in parallel with the first solenoid valve 22 in said fuel pressure control circuit d and through an orifice 26 which bypasses the second solenoid valve 25. The numeral 27 denotes an orifice disposed in the pressure control circuit d on the downstream side of the chamber c. In addition, the fuel pressure control circuit d constitutes a circuit extending through a tank 28, a pump 29, the relief valve 23, the first solenoid valve 22, the second solenoid valve 25, the orifice 26, the pressure difference adjuster 3, and the orifices 24 and 27 and then back to the tank 28.

The numeral 30 denotes an electronic control unit which on-off controls said first and second solenoid valves 22 and 25 by signals, and on the basis of their logics, from an $O_2$ sensor 31, cooling water temperature sensor 32 and suction pipe negative pressure sensor 33 which detect the operating conditions of the engine. Suppose that the first and second solenoid valves 22 and 25 are both in their open state. Then, the chambers b and c of the pressure difference adjuster 3 are subjected to the pressure $P_L$ existing in the upstream side of the fuel measuring gate 15 and the pressure acting on the diaphragm 17, i.e., the pressure difference $P_L-P_F$ across the fuel measuring gate 15, is determined by the elastic forces of the pressure difference setting springs 19 and 20. In this state, if the first solenoid valve 22 is open-close (on-off) controlled by the electronic control unit 30, and if, for example, the close (off) time of the first solenoid valve 22 becomes longer, the pressure $P_L$ in the chamber b falls, whereupon the spring forces of the setting springs 19 and 20 increase the area of opening of variable orifice 36 composed of a self-centering valve 34 and a valve seat 35 disposed in the chamber a so that the pressure difference $P_L-P_F$ between the chambers a and b is at a predetermined value, thereby decreasing the pressure in the chamber a. As a result, the pressure $P_F$ in the downstream side of the fuel measuring gate 15 decreases according to the decrease of the pressure in the chamber b. At this time, the pressure $P_L$ in the upstream side of the fuel measuring gate 15 is maintained at a predetermined value by the relief valve 23 and therefore the pressure difference $P_L-P_F$ across the fuel measuring gate 15 increases and the amount of fuel measured therein is compensated to increase. In brief, the air-fuel ratio is compensated toward the fuel-rich side according to the operating conditions of the engine. Conversely, if the open (on) time of the first solenoid valve 22 becomes longer, the air-fuel ratio is compensated toward the fuel lean side by the reversed operation according to the operating conditions of the engine. In addition, the magnitude of the elastic forces of the pressure difference setting springs 19 and 20 have been set toward the fuel lean side.

In the state where the air-fuel ratio has been compensated in this manner by the first solenoid valve 22 according to the operating conditions of the engine and the ideal air-fuel ratio has been obtained, if the second solenoid valve 25 is open-close (on-off) controlled by the output time ratio of the rich and lean signals from the sensor which detects the operating conditions of the engine, the pressure $P_L$ in the chamber c acting on the diaphragm 18 decreases as the close (off) time of the second solenoid valve 25 becomes longer. This pressure decrease of the chamber c can decrease the pressure $P_F$ in the chamber a in the same manner as described above to compensate the air-fuel ratio toward the fuel rich side. In a reversed case, the air-fuel ratio can be compensated toward the fuel lean side. Unlike the case of detecting the operating conditions of the engine by said first solenoid valve 22 and adapting the air-fuel ratio to all the operating conditions of the engine, the compensation of the air-fuel ratio by the second solenoid valve 25 uses the output time ratio of rich and lean signals as a control factor. Thus, it can be considered to be the compensation of said basic air-fuel ratio set by the servomechanism A. Therefore, said air-fuel ratio can be maintained at a desired constant value and the time required for the compensation of the air-fuel ratio to adapt the latter to the operating conditions of the engine can be reduced. That is, the response characteristic of control can be improved. This will be later described in more detail.

The control operation on the first and second solenoid valves 22 and 25 by the electronic control unit will now be described with reference to FIGS. 2 through 6.

Figure 2:
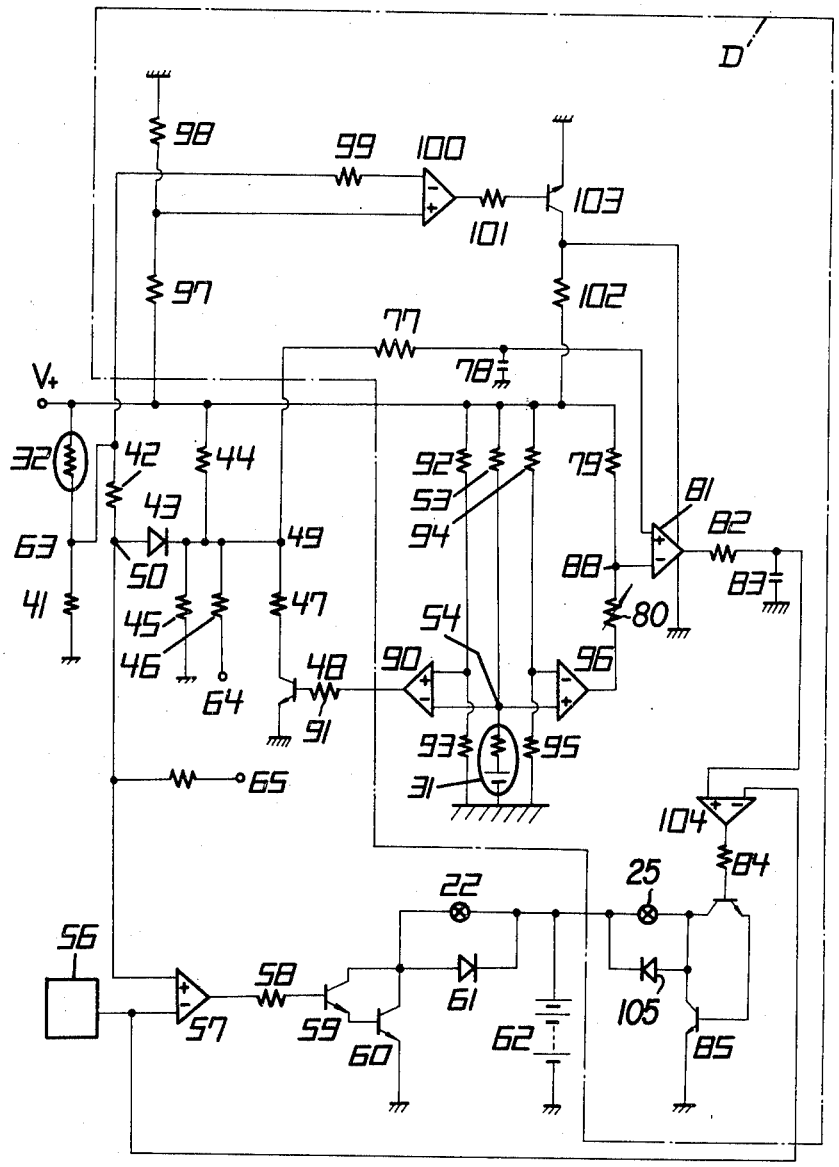
FIG. 2 is a circuit diagram of an electronic control unit of the present inventive apparatus.

FIG. 2 is a circuit diagram of the electronic control unit 30. In this figure, the numeral 32 denotes a water temperature sensor for detecting the engine cooling water temperature. The voltage at a junction 63 between said water temperature sensor 32 and a fixed resistor 41 changes with the temperature of the water temperature sensor 32. As the temperature rises, the resistance decreases and the voltage increases. In a reversed case, the voltage decreases. The voltage at the junction 63 is applied to the non-reversed input side of a comparing unit 57 through a resistor 42, while a signal from a triangular wave generator 56 is applied to the reversed input side of the comparing unit 57. The output of the water temperature sensor 32 is connected through a diode 43 to a voltage divider comprising resistors 44, 45 and 47. The numeral 31 denotes an $O_2$ sensor disposed in the exhaust system for detecting the constituents of exhaust gases to generate electric signals, said $O_2$ sensor 31 being connected to a resistor 53 and the reversed input side of a comparing unit 90. Output from the comparing unit 90 is applied to the base of a transistor 48 through a resistor 91, while a constant voltage from a voltage divider comprising resistors 92 and 93 is applied to the non-reversed input side of the comparing unit 90. The collector of the transistor 48 is connected to said resistor 47. Output from the comparing unit 57 is applied to the base of a transistor 59 through a resistor 58 to energize the first solenoid valve 22 connected to the collector of said transistor 59. The numeral 61 denotes a diode disposed in parallel with the first solenoid valve 22; 62 denotes a power source; and 60 denotes an amplifying transistor whose base is connected to the emitter of the transistor 59. By selecting the resistance of the resistor 42 such that it is sufficiently higher than the resistances of the resistors 44, 45, 46 and 47, the maximum value of the input voltage to the comparing unit 57 at a junction 50 is determined by the voltage appearing at a junction 49 constituting a voltage divider. More particularly, if the voltage at a junction 63 is lower than the voltage at the junction 49 (that is, if the water temperature is low), the operation of the diode 43 causes the voltage at the junction 63 to be applied to the comparing unit 57 as input voltage. In a reversed case, said input voltage is determined by the voltage at the junction 49. The voltage at the junction 49 is determined by either the conduction or the cut-off of the transistor 48, and the conduction and cut-off of the transistor 48 are determined by the output from the comparing unit 90.

Now, suppose that the temperature of the $O_2$ sensor 31 is low and its internal resistance is high or that said temperature is high and a rich signal is being emitted. Then, the voltage on the reversed input side of the comparing unit 90 (i.e., the voltage at the junction 54) is higher than the voltage on the non-reversed input side (constant voltage), so that the comparing unit 90 does not energize the transistor 48. As a result, the voltage at the junction 49 is determined by the resistors 44 and 45 and becomes high. When the $O_2$ sensor 31 is emitting a lean signal while it is at a high temperature, the voltage at the junction 54 is low and the output from the comparing unit 90 turns plus to thereby energize the transistor 48. In this case, therefore, the voltage at the junction 49 is determined by the resistors 44, 45 and 47 and becomes low.

Thus, the voltage at the junction 49 produces a pulse (rectangular voltage) having an amplitude which is determined by the resistors 44, 45 and 47 depending upon the temperature and $\lambda$ signal (rich or lean signal) from the $O_2$ sensor 31.

Figure 3:
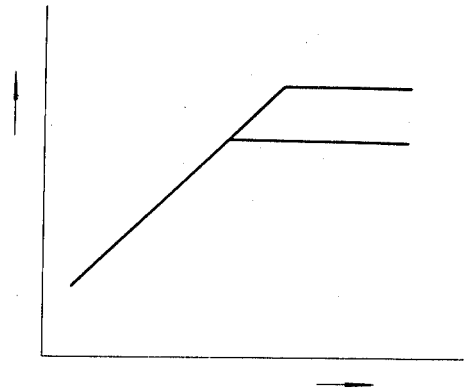
FIG. 3 is a view showing a control voltage in a comparing unit 57 included in the circuit shown in FIG. 2.

If, therefore, the resistors 44, 45 and 47 have sufficiently lower resistances than the resistor 42, the voltage appearing at the junction 50 is controlled by the water temperature sensor 32 and $O_2$ sensor 31, as shown in FIG. 3. The voltage at the junction 50 is applied to the non-reversed input side of the comparing unit 57 and compared with a triangular wave of constant amplitude and constant period produced by the triangular wave generator 56 on the reversed input side of the comparing unit 57. If the control voltage at the junction 50 is higher than said triangular wave voltage, the output from the comparing unit 57 turns plus. As a result, the transistor 59 becomes conductive and further the transistor 60 becomes conductive, so that a current from the power source 62 flows to turn on the first solenoid valve 33. On the other hand, if the control voltage at the junction 50 is lower than the triangular wave voltage, the output from the comparing unit 57 is minus, so that the transistors 59 and 60 are cut off and the first solenoid valve 22 is turned off.

Figure 4:
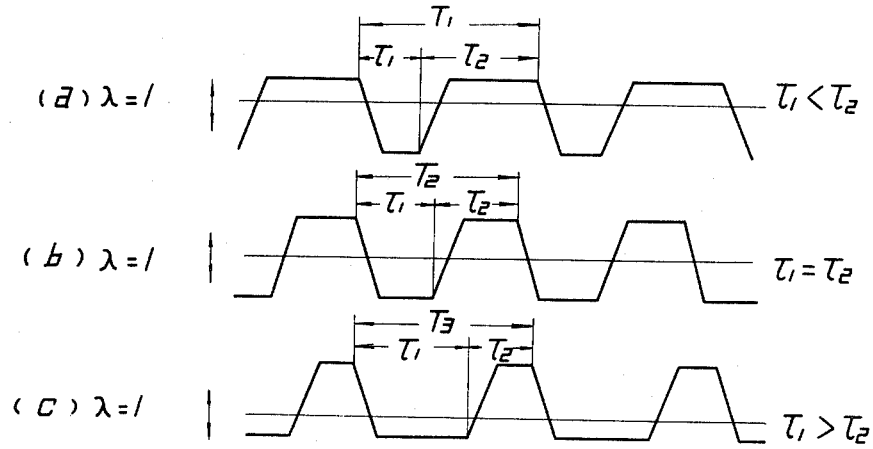
FIG. 4 is a view showing the time ratio of rich and lean signals from an oxygen sensor of the present inventive apparatus.

As a result, the on-off time ratio of the first solenoid valve 22 is controlled by the rectangular voltage at the junction 49 determined by the water temperature sensor 32 and $O_2$ sensor 31 which detect the operating conditions of the engine, and the air-fuel ratio can be made to be the theoretical air-fuel ratio (air excess factor $\lambda=1$) which is adapted for the operating conditions of the engine, in the manner described above. Let $\tau_1$ be the time during which the oxygen sensor is emitting rich signals and $\tau_2$ be the time during which it is emitting lean signals. Then, the air-fuel ratio change patterns can be classified into three types, as shown in FIG. 4 (a), (b) and (c). As is clear from this figure, cycles $T_1$ and $T_3$ where $\tau_1<\tau_2$ as shown at (a) and $\tau_1>\tau_2$ as shown at (c) are longer than a cycle $T_2$ where $\tau_1=\tau_2$ as shown at (b). Thus, $T_1>T_2$, $T_3>T_2$. Therefore, in order to control the air-fuel ratio so that $\lambda=1$, the control period can be made shortest where $\tau_1=\tau_2$, that is, where the oxygen sensor is set so that its rich signal emitting time and its lean signal emitting time are equal, making it possible to obtain a superior engine response characteristic. Therefore, if the relation between the rich signal and lean signal from the oxygen sensor deviates from $\tau_1=\tau_2$, it is necessary to correct the same.

Figure 5:
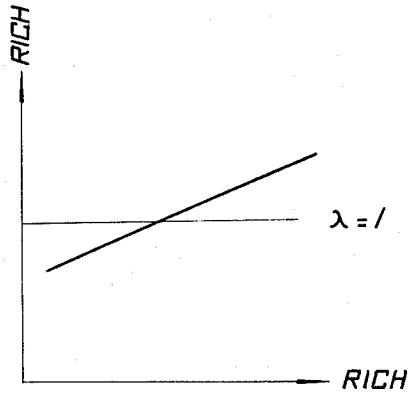
FIG. 5 is a view showing basic air-fuel ratio versus after-control air-fuel ratio characteristics.
Figure 6:
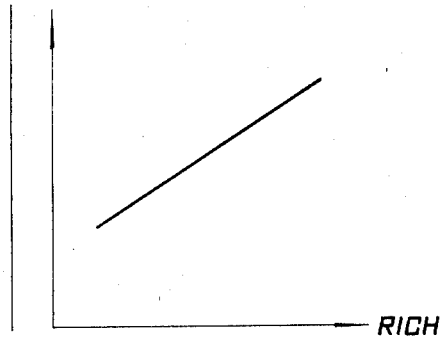
FIG. 6 is a view showing basic air-fuel ratio versus $O_2$ sensor $\lambda$ signal characteristics.

The air-fuel ratio controlled by the first solenoid valve 22 so that $\lambda=1$ is influenced by the basic air-fuel ratio in the servomechanism A, as shown in FIG. 5. If the basic air-fuel ratio deviates toward the fuel rich side in the $O_2$ signal (rich signal output time/lean signal output time), as shown in FIG. 6, the rich signal output time of the $O_2$ sensor 31 becomes long. With this relation taken into consideration, the present invention is intended to compensate the basic air-fuel ratio so that control effected by the first solenoid valve 22 provides the relation $\tau_1=\tau_2$ if the first solenoid valve 22 deviates from the relation $\tau_1=\tau_2$ by on-off controlling the second solenoid valve 25 placed in the fuel control pressure circuit d to change the set value in the pressure difference adjuster 3 and change the pressure difference $P_L-P_F$ across the fuel measuring gate 15.

This will now be described in more detail. The portion D in FIG. 2 is the control circuit for the second solenoid valve 25. A comparing unit 96 compares the voltage at the junction 54 caused to change by the $O_2$ sensor 31 with a constant voltage provided by a voltage divider comprising resistors 94 and 95. A comparing unit 81 applies the voltage at the junction 49 to the non-reversed input side through a resistor 77 and a capacitor 78 and also applies the voltage at a junction 88 between a resistor 79 and a variable resistor 80 to the reversed input side so as to compare these voltages. If the $O_2$ sensor 31 is at high temperature and is emitting a lean signal and the voltage at the junction 54 is low, the transistor 48 is energized by the comparing unit 90, with the voltage at the junction 49 presenting a low value determined by the resistors 44, 45 and 47, so that this voltage applied to the non-reversed input side of the comparing unit 81 and smoothed by the resistor 77 and capacitor 78 is lower than the voltage at the junction 88 and the comparing unit 81 produces a voltage corresponding to "0". Reversely, if the $O_2$ sensor 31 is at high temperature and is emitting a rich signal, the voltage on the non-reversed input side of the comparing unit 81 becomes higher than the voltage on the reversed input side and the comparing unit 81 produces a voltage corresponding to "1". This output voltage from the comparing unit 81 is smoothed by an integrating circuit comprising a resistor 82 and a capacitor 83 and applied to the non-reversed input side of a comparing unit 104. The reversed input side of the comparing unit 104 has applied thereto the output voltage from the triangular wave generator 56. Therefore, if the average voltage produced by the comparing unit 81 is higher than the output voltage from the triangular wave generator 56, the comparing unit 104 provides a plus output and energizes the transistors 84 and 85 to turn on (open) the second solenoid valve 25. In a reversed case, it turns off (closes) the second solenoid valve 25. The period of this opening and closing operation is determined by the period of the triangular wave voltage produced by the triangular wave generator. Further, the open-close time ratio is determined by the voltage on the non-reversed input side of the comparing unit 104. In addition, the numeral 105 denotes a diode disposed in parallel with the solenoid valve 25.

In cases where the lean signal output time of the $O_2$ sensor 31 is longer than the rich signal output time thereof, i.e., $\tau_1<\tau_2$ as shown at (a) in FIG. 4, the output from the comparing unit 81 has a longer time that a voltage corresponding to "0" is being produced, with the result that the voltage applied to the non-reversed input side of the comparing unit 104 and averaged by the resistor 82 and capacitor 83 exhibits a value of "0.5" or less. In such cases, the off (closed) time of the second solenoid valve 25 is longer than the on (open) time thereof. As a result, the pressure $P_L$ in the chamber c of the pressure difference adjuster 3 lowers and the pressure $P_F$ in the chamber a is compensated so that it decreases, and the basic air-fuel ratio is compensated toward fuel rich side, i.e., $\tau_1=\tau_2$. If the rich signal output time of the $O_2$ sensor is longer than the lean signal output time thereof, a reversed operation is performed to effect compensation such that the opened and closed times of the first solenoid valve 22 are equal to each other, i.e., $\tau_1=\tau_2$.

Thus, the air-fuel ratio can be compensated over the entire operating time so as to be equal to the theoretical air-fuel ratio by detecting the operating conditions of the engine, and moreover the response characteristic can be improved by shortening the cycle of the first solenoid valve 22 needed for compensation.

Further, according to the present invention, the control circuit D for the second solenoid valve 25 is so arranged that the $O_2$ sensor detects the time to start the normal operation to compensate the basic air-fuel ratio, i.e., only when the cooling water temperature is above the set temperature and the $O_2$ sensor 31 is in its active state, it compensates the basic air-fuel ratio to achieve the compensation of the normal basic air-fuel ratio. This operation is effected such that the maximum value of output from the $O_2$ sensor 31 is compared with the set value in the comparing unit 96 and the resistors 79 and 80 are set at such a value that if said maximum value is greater than the set value (when the internal resistance of the $O_2$ sensor 31 is high as when it is at low temperature or out of order), the voltage on the reversed input side of the comparing unit 81 is always higher than the voltage on the non-reversed input side thereof, so that the comparing unit 81 produces no output. Further, the output from the cooling water temperature sensor 32 is applied to the reversed input side of a comparing unit 100 through a resistor 99 while the voltage between resistors 97 and 98 which constitute a voltage divider is applied to the non-reversed input side, so as to compare these voltages and if the voltage at the junction 63 is lower than the set value, i.e., when the cooling water temperature is lower than the set temperature, the comparing unit 100 produces a plus output to energize a transistor 103 through a resistor 101. The collector of the transistor 103 is connected to the power source through a resistor 102 and also to the power source circuit of the comparing unit 81 and when it is energized it cuts off the passage to the power source circuit of the comparing unit 81. If the cooling water temperature becomes higher than the set value, the comparing unit 100 renders the transistor 103 non-conductive and allows an electric current to flow from the power source to the power source circuit of the comparing unit 81 through the resistor 102.

In addition, in the above description, the control factors for the electronic control unit 30 have been limited to signals from the $O_2$ sensor 31 and cooling water temperature sensor 32, but if further control factors, such as acceleration and full throttle, are added to the terminal 64 and 65 shown in FIG. 2, the air-fuel ratio can be adapted to the operating conditions of the engine more accurately. Further, it has been so arranged that a triangular wave voltage is applied to the reversed input side of the comparing unit 57 and a signal voltage which changes with the operating conditions of the engine is applied to the non-reversed input side thereof. However, reversed connection is possible by changing the arrangement of the output amplifying circuit which drives the first solenoid valve 22 or the construction of the first solenoid valve 22. The same may be said of the comparing units 81 and 104.

The numeral 25 has been described as a solenoid valve which intermittently performs an on-off operation. However, the control operation of equalizing the lean signal output time of the sensor to the rich signal output time thereof can be attained by replacing the second solenoid valve 25 by a variable orifice designed so that its degree of opening changes with signals from the electronic control unit 30.

What is claimed is:

1. A fuel injection apparatus of the type comprising air flow rate detecting means having a servomechanism and a valve opening mechanism for maintaining at a predetermined value the pressure difference across a throttle valve disposed in a suction pipe and detecting the flow rate of air to an internal combustion engine from the degree of opening of said throttle valve, fuel flow rate measuring means disposed in a fuel supply passage and having a fuel measuring gate which is connected to said throttle valve and whose degree of fluid-communication uniquely corresponds to the degree of opening of said throttle valve, pressure adjusting means for regulating the pressure differences across said fuel measuring gate, a plurality of sensor means for sensing the operating conditions of the engine and for emitting sensed signals, electronic control unit means which receives said sensed signals and emits control signals based on said sensed signals, and a first solenoid valve disposed in a fuel pressure control circuit and adapted to be opened and closed by said control signals which are emitted from said electronic control unit means for adjusting a set value of said pressure adjusting means by the open-close action thereof to compensate the air-fuel ratio so as to adapt to all the operating conditions of said engine, characterized in that said fuel injection apparatus further comprises a second solenoid valve disposed in said fuel pressure control circuit in parallel with the first solenoid valve, said solenoid valve being adapted to be opened and closed by output time ratio of fuel rich and lean signals which are emitted from said electronic control unit means so as to correct the basic air-fuel ratio determined in connection with said servo-mechanism of the air flow rate detecting means and said fuel measuring gate when said engine is in operating condition, thereby maintaining said fuel-air ratio at a desired constant value.

2. The fuel injection apparatus of claim 1 in which the electronic control unit has means for producing control signals for controlling the open-close (on-off) time of the first and second solenoids by causing these signals to selectively change the open-close (on-off) time of the solenoids, whereby these control signals correspond to the open-close (on-off) time ratios of at least one of said solenoids.

3. The fuel injection apparatus of claim 2 in which the sensor means has an oxygen sensor that detects the operating conditions of the engine, comprising at least the oxygen content of the air-fuel mixture so that the oxygen content detected is a function of the air-fuel ratios for producing rich and lean voltage signals corresponding to rich and lean air-fuel ratios.

4. The fuel injection apparatus of claim 3 in which the electronic control unit means has sensor means for producing rich and lean signals as a control factor for changing the turn-off times of at least one of the solenoids.

5. The fuel injector apparatus of claim 4 in which:

the first solenoid is disposed in the fuel control pressure circuit, whereby it is adapted to be opened and closed by the control signals for compensating for the basic air-fuel ratio in accordance with the operating conditions of the engine by adjusting the set value of the pressure adjusting means; and said second solenoid valve is placed in the fuel control pressure circuit in parallel with the first solenoid to correct the basic air-fuel ratio by changing the set value of said pressure adjusting means and the pressure difference across the fuel measuring gate, thereby to maintain the air-fuel ratio at a desired constant value when the engine is in operation.

6. The fuel injector apparatus of claim 5 in which the electronic control unit has means for producing control signals that are equal in time and amplitude.

7. The fuel injector apparatus of claim 6 in which the electronic control unit has means employing a triangular wave of constant amplitude and constant period for determining the equality of the control signals.

8. The fuel injection apparatus of claim 7 in which the electronic control unit produces a rectangular voltage having an amplitude that corresponds to the rich-lean ratio of the air-fuel mixture sensed by the sensor means for comparing the same to said triangular wave for producing a positive or a negative signal for turning at least one of the solenoids on or off in accordance with the comparison.

9. The fuel injector apparatus of claim 8 in which the rectangular voltage signal is changed by the sensor means to change the on-off time ratio of at least one of said solenoids.

* * * * *